US009918360B2

(12) United States Patent
Lee et al.

(10) Patent No.: US 9,918,360 B2
(45) Date of Patent: Mar. 13, 2018

(54) LIGHT-EMITTING DIODE LIGHTING APPARATUS

(71) Applicant: Seoul Semiconductor Co., Ltd., Ansan-si (KR)

(72) Inventors: Chung Hoon Lee, Ansan-si (KR); Keon Young Lee, Ansan-si (KR)

(73) Assignee: Seoul Semiconductor Co., Ltd., Ansan-si (KR)

( * ) Notice: Subject to any disclaimer, the term of this patent is extended or adjusted under 35 U.S.C. 154(b) by 215 days.

(21) Appl. No.: 14/413,838

(22) PCT Filed: Jul. 8, 2013

(86) PCT No.: PCT/KR2013/006021
§ 371 (c)(1),
(2) Date: Jan. 9, 2015

(87) PCT Pub. No.: WO2014/010889
PCT Pub. Date: Jan. 16, 2014

(65) Prior Publication Data

US 2015/0195876 A1 Jul. 9, 2015

(30) Foreign Application Priority Data

Jul. 9, 2012 (KR) ..... 10-2012-0074376

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 33/08*** | (2006.01) |
| *F21Y 101/00* | (2016.01) |
| *F21Y 115/10* | (2016.01) |

(52) U.S. Cl.
CPC ..... *H05B 33/0809* (2013.01); *H05B 33/083* (2013.01); *H05B 33/0815* (2013.01);
(Continued)

(58) Field of Classification Search
CPC ..... H05B 33/0815; H05B 33/083; H05B 33/0845; H05B 33/08; F21Y 2101/00; F21Y 2115/10
(Continued)

(56) References Cited

U.S. PATENT DOCUMENTS 8,299,724 B2 10/2012 Huynh
8,456,095 B2 4/2013 Huynh
(Continued)

FOREIGN PATENT DOCUMENTS

JP 3082719 12/2001
JP 2011-159495 8/2011
(Continued)

OTHER PUBLICATIONS

International Search Report dated Oct. 10, 2013 in International Application No. PCT/KR203/006021.
(Continued)

*Primary Examiner* — Alexander H Taningco
*Assistant Examiner* — Christian L Garcia
(74) *Attorney, Agent, or Firm* — H.C. Park & Associates, PLC

(57) ABSTRACT

A lighting apparatus using light emitting diodes is disclosed. A plurality of light-emitting groups are connected to each other in series at an output terminal of a rectification unit. Current diodes as current sources are branched from a node between the light-emitting groups. Current values set in the current diodes are set according to the amount of current flowing into the light-emitting groups. Therethrough, the amount of current flowing in each light-emitting group can be determined.

3 Claims, 5 Drawing Sheets

(52) U.S. Cl.
CPC ..... *F21Y 2101/00* (2013.01); *F21Y 2115/10* (2016.08); *H05B 33/08* (2013.01); *H05B 33/0845* (2013.01)

(58) Field of Classification Search
USPC ... 315/291, 312, 247, 307, 185 R, 224, 294; 362/800
See application file for complete search history.

(56) References Cited

U.S. PATENT DOCUMENTS

| | | | | |
|---|---|---|---|---|
| 2010/0295458 | A1 | 11/2010 | Cheng et al. | |
| 2010/0295460 | A1* | 11/2010 | Lin | H05B 33/0812 315/193 |
| 2013/0043799 | A1* | 2/2013 | Siu | H05B 33/0824 315/193 |
| 2013/0099683 | A1* | 4/2013 | Sakuragi | H05B 33/083 315/185 R |
| 2015/0115810 | A1* | 4/2015 | Akiyama | H05B 33/0803 315/185 R |

FOREIGN PATENT DOCUMENTS

| | | |
|---|---|---|
| JP | 2011-198739 | 10/2011 |
| KR | 10-2010-0002474 | 1/2010 |
| KR | 10-2010-0126161 | 12/2010 |

OTHER PUBLICATIONS

Written Opinion dated Oct. 10, 2013 in International Application No. PCT/KR203/006021.

* cited by examiner

【Fig. 1】
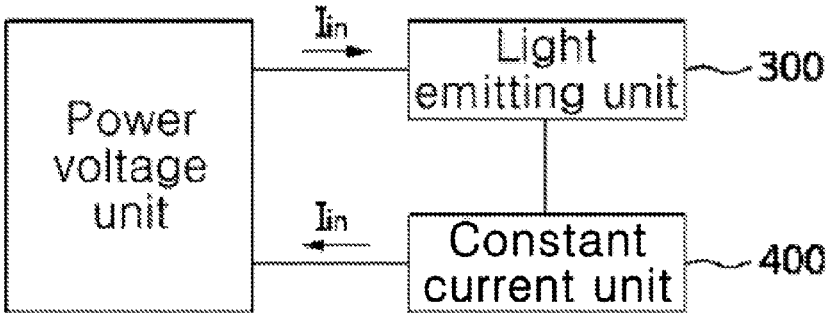

[Fig. 2]
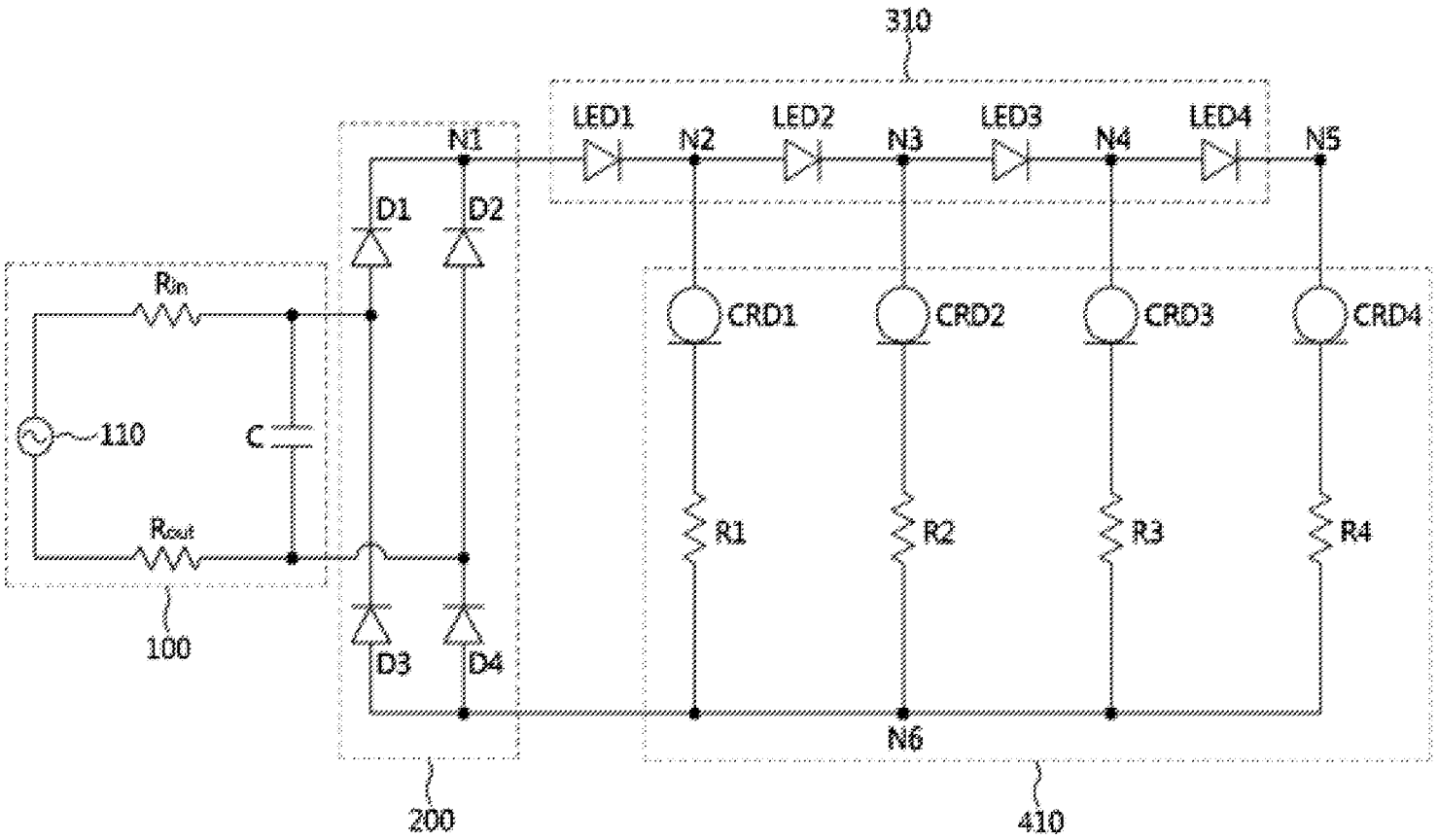

【Fig. 3】
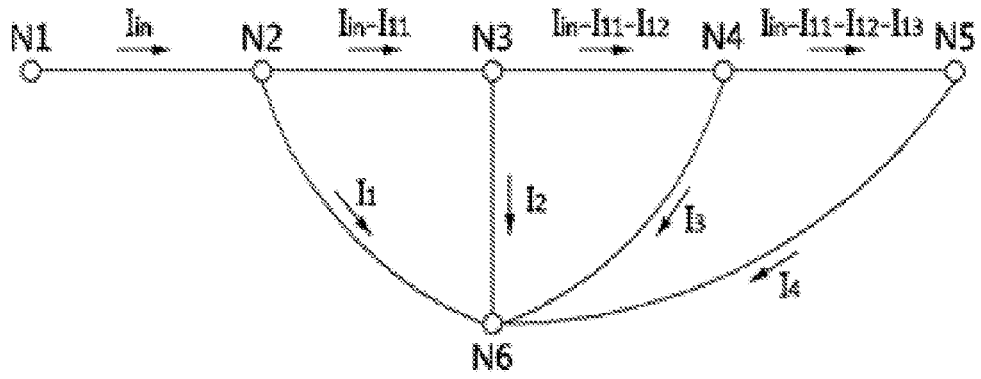

[Fig. 4]
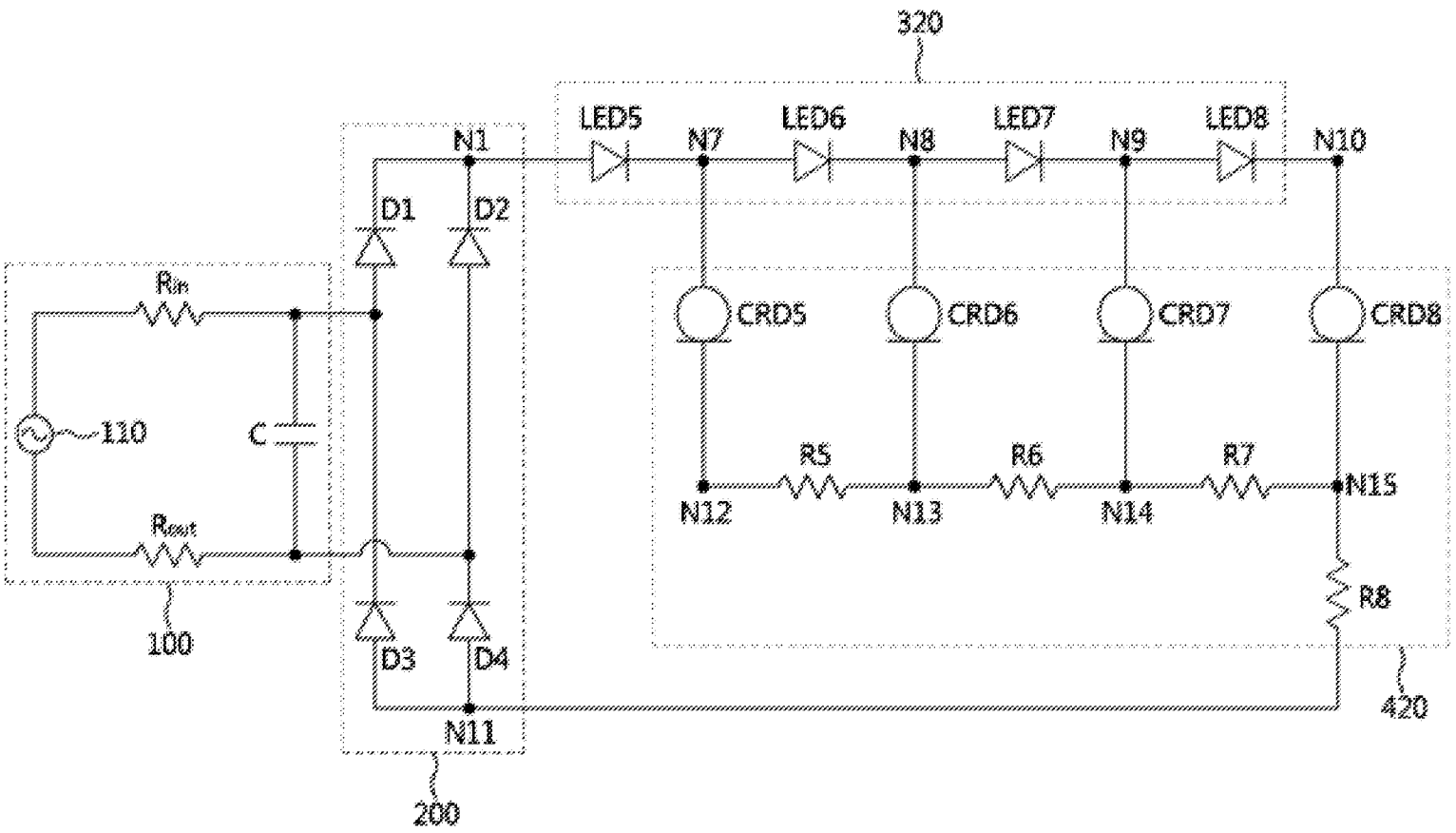

【Fig. 5】
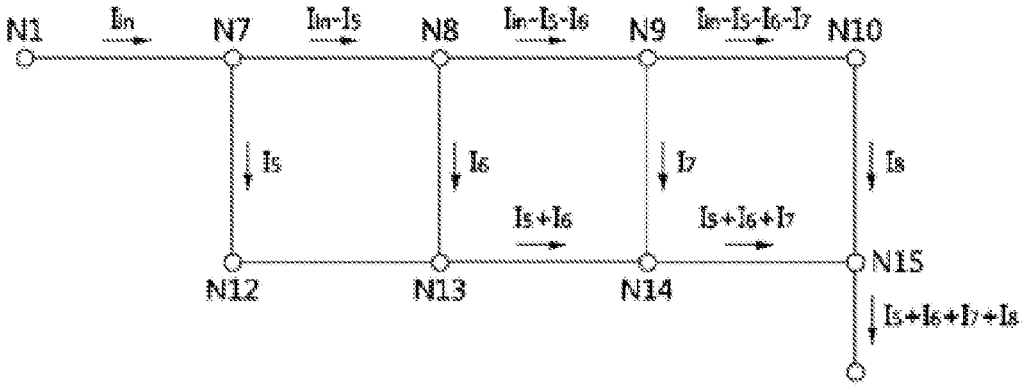
【Fig. 6】
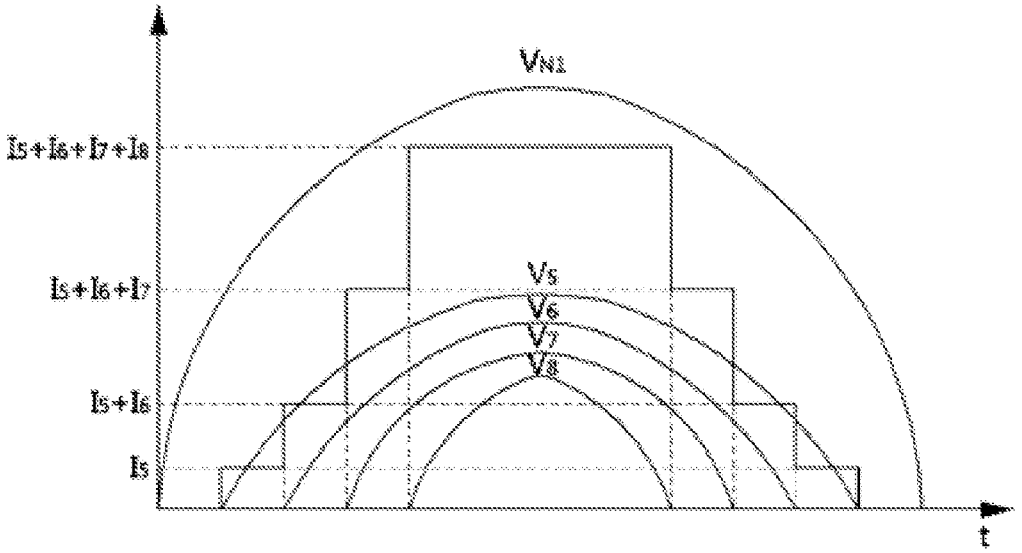

LIGHT-EMITTING DIODE LIGHTING APPARATUS

CROSS-REFERENCE TO RELATED APPLICATIONS

This application is the National Stage Entry of International Application PCT/KR2013/006021, filed on Jul. 8, 2013, and claims priority from and the benefit of Korean Patent Application No. 10-2012-0074376, filed on Jul. 9, 2012, each of which is incorporated herein by reference for all purposes as if fully set forth herein.

BACKGROUND

Field

The present invention relates to a light-emitting diode lighting apparatus, and more particularly, to a light-emitting diode lighting apparatus which rectifies output of an alternating current (AC) power source and supplies uniform power to light emitting diodes.

Discussion of the Background

A light-emitting diode lighting apparatus is used as a backlight unit for portable devices or as a general lighting apparatus.

A lighting apparatus used as the backlight unit for portable devices employs direct current (DC) voltage of a portable power source. Accordingly, studies on improvement of efficiency or power factor of the power source used therefor have been not carried out in practice. This is caused by characteristics of a light emitting diode which consumes power of the lighting apparatus, and insignificant improvement of power consumption through a particular circuit design. In addition, when DC voltage is used by the power source, harmonics components according to Fourier analysis become insignificant. Thus, reduction in power factor resulting from complex frequency components becomes insignificant.

On the other hand, when light emitting diodes are used in a general lighting apparatus, ripple voltage is applied to the light emitting diodes. The ripple voltage causes a problem of improvement in power consumption and power factor. In addition, each of the light emitting diodes using ripple voltage is also required to emit light with uniform brightness as well as improvement in power consumption and power factor. Brightness of the light emitting diode depends upon current flowing through the light emitting diode rather than voltage applied thereto. This is because the light emitting diode has a mechanism of emitting light through recombination of excited electrons and holes. Thus, it is necessary for the lighting apparatus to allow uniform current to flow through the light emitting diodes.

Some lighting apparatuses employ switching elements in order to allow uniform current to flow through the light emitting diodes.

Uniform current can be supplied to the light emitting diodes through on/off control of the switching elements and current path thereby, whereby each of the light emitting diodes can emit light with the same level of brightness.

Further, a current source is used in order to allow the light emitting diodes to emit light with the same level of brightness. In order to realize the same level of brightness between the light emitting diodes, it is necessary to set a variety of current paths. Therefore, there is a need for a technology that can operate a plurality of light emitting diode groups using an active element and can supply uniform current to the light emitting diodes to secure brightness uniformity while improving power factor and efficiency.

SUMMARY

Embodiments of the invention provide a lighting apparatus that allows easy control of current supplied to light emitting diodes such that the amount of current flowing through each light-emitting group composed of the light emitting diodes can be controlled through control of the current.

One aspect of the invention provides a light-emitting diode lighting apparatus, which includes: an AC voltage supply supplying AC voltage; a rectification unit rectifying the AC voltage; a light-emitting unit receiving rectified voltage supplied from the rectification unit and performing light emitting operation through at least one light-emitting group; and a constant current unit including current diodes branched from nodes between light-emitting groups of the light-emitting unit and setting a current of each of the light-emitting groups.

Another aspect of the present invention provides a light-emitting diode lighting apparatus, which includes: an AC voltage supply supplying AC voltage; a rectification unit rectifying the AC voltage to supply rectified voltage to a first node; a light-emitting unit is connected to the first node and performing light emitting operation; and a constant current unit branched from each node of the light-emitting unit and setting a current flowing through the light-emitting unit.

According to embodiments of the invention, light emitting diodes of a light-emitting unit can be operated to emit light with uniform brightness through suitable arrangement of the light emitting diodes constituting light-emitting groups.

In addition, a difference in power consumption between distribution resistors can be minimized by a difference in resistance therebetween. As a result, it is possible to prevent damage caused by overcurrent in the constant current unit.

BRIEF DESCRIPTION OF THE DRAWINGS

FIG. 1 is a block diagram of a lighting apparatus according to one exemplary embodiment of the invention.

FIG. 2 is a circuit diagram of a lighting apparatus according to another exemplary embodiment of the invention.

FIG. 3 is a directed graph representing a circuit network model of the lighting apparatus shown in FIG. 2.

FIG. 4 is a circuit diagram of a lighting apparatus according to a further exemplary embodiment of the invention.

FIG. 5 is a directed graph representing a circuit network model of the lighting apparatus shown in FIG. 4.

FIG. 6 is a voltage-current graph representing operation of the lighting apparatuses shown in FIG. 2 and FIG. 4.

DETAILED DESCRIPTION OF THE ILLUSTRATED EMBODIMENTS

Exemplary embodiments of the invention will now be described in detail with reference to the accompanying drawings. However, it should be understood that the present invention is not limited thereto and may be embodied in various ways.

As used herein, although the terms "first", "second", "third", and the like may be used to describe various elements, components, regions, layers and/or sections, these elements, components, regions, layers and/or sections are not limited by these terms, and are only used to distinguish one element, component, region, layer or section from another element, component, region, layer or section.

Embodiments

FIG. 1 is a block diagram of a lighting apparatus according to one exemplary embodiment of the invention.

Referring to FIG. 1, the lighting apparatus according to this exemplary embodiment includes a power voltage unit 10, a light-emitting unit 300, and a constant current unit 400.

The power voltage unit 10 supplies voltage to the light-emitting unit 300. The voltage may be supplied in the form of ripple voltage through full-wave rectification. Here, any power source may be used as the power voltage unit so long as the power source can supply a suitable level of power for light emitting operation of the light-emitting unit 300.

In addition, the light-emitting unit 300 receives the voltage supplied from the power voltage unit and performs light emitting operation. The operation of the light-emitting unit 300 is controlled by the constant current unit 400. Further, the light-emitting unit 300 includes a plurality of light-emitting groups. Each of the light-emitting groups constitutes the light-emitting unit 300. Each of the light-emitting groups includes at least one light emitting diode.

Corresponding to the light-emitting groups of the light-emitting unit 300, the constant current unit 400 is provided with current sources. For example, a single light-emitting group may be operated to emit light corresponding to a single power source. That is, the current source determines the amount of current flowing through the light-emitting group.

FIG. 2 is a circuit diagram of a lighting apparatus according to another exemplary embodiment of the invention Referring to FIG. 2, the lighting apparatus according to this exemplary embodiment includes a power voltage unit 10, a light-emitting unit 310, and a constant current unit 410.

The power voltage unit 10 includes an AC power supply 100 and a rectification unit 200.

The AC power supply 100 supplies AC voltage. The AC power supply 100 includes an AC power source 110, resistors Rin and Rout, and a capacitor C. The AC power source 110 may be a domestic power source having an RMS value of 220V, or another AC power source having a different RMS value. In addition, the resistors Rin and Rout and the capacitor C connected to the AC power source 110 act as low pass filters. For example, when the AC power source 110 supplies AC voltage at a frequency of 60 Hz, harmonics components included in the AC voltage are filtered by the resistors Rin and Rout and the capacitor C. The AC voltage supplied from the AC power supply 100 enters the rectification unit 200.

The rectification unit 200 rectifies the AC voltage. For example, the rectification unit 200 may have a bridge structure including four diodes D1, D2, D3 and D4. With the configuration as shown in FIG. 1, the rectification unit 200 can perform full-wave rectification of the AC voltage supplied from the AC power supply 100. For example, when the AC voltage is a sine wave having a frequency of 60 Hz, the rectification unit 200 performs full-wave rectification of the AC voltage. As a result, (−) ripple components of the AC voltage are inverted and the rectification unit 200 outputs only (+) ripple components between a first node N1 and a sixth node N6.

The light-emitting unit 310 is electrically connected to the first node N1, which is an output terminal of the rectification unit 200. The light-emitting unit 310 includes a plurality of light-emitting groups LED1, LED2, LED3 and LED4. Each of the light-emitting groups LED1, LED2, LED3 and LED4 includes at least one light emitting diode or at least one light emitting diode chip. In addition, the light emitting diodes constituting each of the light-emitting groups LED1, LED2, LED3 and LED4 may have different features.

In FIG. 2, the light-emitting groups LED1, LED2, LED3 and LED4 may be connected to one another in series. In addition, the number of light-emitting groups connected to one another in series may differ according to embodiments.

The constant current unit 410 may be connected between the light-emitting unit 310 and the sixth node N6. The constant current unit 410 includes a current source. The current source may be composed of current diodes. The current diodes refer to electronic elements capable of supplying a predetermined amount of current even in the case of variation in voltage applied thereto. Thus, current diodes CRD1, CRD2, CRD3 and CRD4 can stabilize brightness of the light emitting diodes in the light-emitting unit 310.

Further, the current source may be realized in various forms. For example, any two-terminal elements capable of generating current may be used as the current source.

The constant current unit 410 includes current diodes CRD1, CRD2, CRD3 and CRD4, which are branched from nodes N2, N3, N4 and N5 between the light-emitting groups LED1, LED2, LED3 and LED4 connected to one another in series. In addition, the constant current unit 410 further includes distribution resistors R1, R2, R3 and R4 connected to the current diodes CRD1, CRD2, CRD3 and CRD4, respectively. Accordingly, the current diodes CRD1, CRD2, CRD3 and CRD4 and the distribution resistors R1, R2, R3 and R4 are connected to circuit branches extending from nodes between the light-emitting groups LED1, LED2, LED3 and LED4.

For example, a first current diode CRD1 and a first distribution resistor R1 are connected to a second node N2, and a second current diode CRD2 and a second distribution resistor R2 are connected to a third node N3. In addition, a third current diode CRD3 and a third distribution resistor R3 are connected to a fourth node N4, and a fourth current diode CRD4 and a fourth distribution resistor R4 are connected to a fifth node N5.

FIG. 3 is a directed graph representing a circuit network model of the lighting apparatus shown in FIG. 2.

Referring to FIG. 3, assuming that pull-in current In flows through a branch between the first node N1 and the second node N2. In FIG. 2, the current Iin flows through a first light-emitting group LED1.

In addition, the first current diode CRD1 is provided to a branch between the second node N2 and the sixth node N6. A current flowing through the first current diode CRD1 is defined as a first current I1. Thus, a current flowing through a branch between the second node N2 and the third node N3 becomes Iin-I1. That is, the current flowing through a second light-emitting group LED2 becomes Iin-I1.

Further, the second current diode LED2 is provided to a branch between the third node N3 and the sixth node N6. A current flowing through the second current diode LED2 is defined as a second current I2. Thus, a current flowing through a branch between the third node N3 and the fourth node N4 becomes Iin-I1-I2. Accordingly, the current Iin-I1-I2 flows through a third light-emitting group LED3.

The current Iin-I1-I2 flowing through the third light-emitting group LED3 enters the fourth node N4. The third current diode CRD3 is provided to a branch between the fourth node N4 and the sixth node N6, and a current flowing through the third current diode CRD3 is defined as a third current I3. Accordingly, a current flowing through a fourth light-emitting group LED4 placed between the fourth node N4 and the fifth node N5 becomes Iin-I1-I2-I3. This current is the same as a fourth current I4 flowing through the fourth current diode CRD4 provided to a branch between the fifth node N5 and the sixth node N6.

This means that the pull-in current Iin flowing from the first node is I1+I2+I3+I4. That is, a current flowing through each of the light-emitting groups connected to one another in series does not exhibit characteristics according to a typical voltage-current curve, and depends on a current value set to a current diode branched from a node between the light-emitting groups connected to each other in series.

That is, the current flowing through each of the light-emitting groups is represented by the following equations.

Current $I$in flowing through first light-emitting group=$I1+I2+I3+I4$ Equation 1

Current $I$in-$I1$ flowing through second light-emitting group=$I2+I3+I4$ Equation 2

Current $I$in-$I1$-$I2$ flowing through third light-emitting group=$I3+I4$ Equation 3

Current $I$in-$I1$-$I2$-$I3$ flowing through fourth light-emitting group=$I4$ Equation 4

According to these equations, when the pull-in current Iin enters the second node N2, a current of a current diode provided to the farthest node from the second node N2 flows through light-emitting groups connected to the farthest node from the second node N2. In FIG. 3, the fourth current I4 of the fourth current diode CRD4 commonly flows through all of the light-emitting groups LED1, LED2, LED3 and LED4. This means that a current of a current diode provided to a branch between light-emitting groups connected to each other in series commonly flows through other light-emitting groups provided to previous branches.

The current values I1, I2, I3 and I4 set to the current diodes to flow through the branches may be selected in various ways.

Preferably, the current value of the current diode branched from the farthest node from the second node N2, which the pull-in current Iin enters, is set to the highest value. For example, the current values of the current diodes may be set according to the following equation.

$$I4>I3>I2>I1 \quad \text{Equation 5}$$

In this equation, the fourth current I4 of the fourth current diode CRD4 has the highest current value. In addition, the first current I1 has the lowest current value. As a result, a difference in current between the light-emitting groups can be minimized. Further, the current flowing through each of the light-emitting groups LED1, LED2, LED3 and LED4 provided to the branches may be individually set through adjustment of the current of each of the current diodes CRD1, CRD2, CRD3 and CRD4.

For example, the current flowing through the fourth light-emitting group LED4 is the fourth current of the fourth current diode CRD4, and the current flowing through the third light-emitting group LED3 is determined by the third current I3 and the fourth current I4. Here, since the fourth current I4 of the fourth current diode CRD4 is previously determined, the current flowing through the third light-emitting group LED3 may be arbitrarily determined by setting the third current I3.

This means that a maximum amount of current flowing through each of the light-emitting groups may be controlled by setting the current flowing through the current diodes instead of adjustment of resistance or voltage.

Further, in this embodiment, magnitude of resistance provided to directional branches connected to the sixth node N6 may be changed in various ways.

For example, distribution resistors provided to respective directional branches may have different resistance values. For example, the resistance values of the distribution resistors may be set to increase with decreasing distance to the first node N1. Such a difference in resistance between the distribution resistors may be set after determination of the current values as represented by Equation 5. With such a feature, power consumed by the respective directional branches can be efficiently distributed. The difference in resistance between the distribution resistors may be set according to the following equation.

$$R1>R2>R3>R4 \quad \text{Equation 6}$$

In this equation, the current values I1, I2, I3 and I4 flowing through the distribution resistors are determined according to Equation 5. The difference in resistance between the distribution resistors allows efficient distribution of power applied to each of the current diodes. For example, voltage of the second node N2 is kept higher than that of the third node N3. In the case where the distribution resistors are not used, the current diodes are directly connected to the sixth node N6. As a result, voltage between both terminals of each of the current diodes CRD1 and CRD2 is directly affected by the voltage of each of the second node N2 and the third node N3. Accordingly, the voltage between both terminals of the current diode CRD1 is higher than the voltage between both terminals of the current diode CDR2. This condition is undesirable to drive the current diodes. In addition, power generated by each of the distribution resistors is $R*I^2$. That is, power values generated by the distribution resistors are $R1*I1^2$, $R2*I2^2$, $R3*I3^2$ and $R4*I4^2$, respectively. Considering a relationship of $I1<I2<I3<I4$, it is desirable that the resistance values of the distribution resistors be set such that power generated by each of the distribution resistors is uniformly distributed. To this end, the relationship represented by Equation 6 is used. With this structure, power generated between the nodes through each of the distribution resistors can be efficiently distributed. In addition, this structure minimizes power consumed by the current diodes, thereby preventing damage to the current diodes.

FIG. 4 is a circuit diagram of a lighting apparatus according to a further exemplary embodiment of the invention.

Referring to FIG. 4, the lighting apparatus according to this embodiment includes a power voltage unit 10, a light-emitting unit 320, and a constant current unit 420.

The power voltage unit 10 includes an AC power supply 100 and a rectification unit 200.

The AC power supply 100 supplies AC voltage. The AC power supply 100 includes an AC power source 110, resistors Rin and Rout, and a capacitor C. The structures of the AC power source 110, the resistors Rin and Rout and the capacitor C are the same as those of the lighting apparatus described with reference to FIG. 2. Thus, for a description of these components, refer to FIG. 2. The AC voltage supplied from the AC power supply 100 enters the rectification unit 200.

The rectification unit 200 rectifies the AC voltage. For example, the rectification unit 200 may have a bridge structure including four diodes D1, D2, D3 and D4. Operation of the rectification unit 200 is the same as described with reference to FIG. 2. That is, the rectification unit 200 performs full-wave rectification of the AC voltage supplied from the AC power supply 100. Output from the rectification unit 200 is delivered to the light-emitting unit 320 through a first node N1 and an eleventh node N11.

The light-emitting unit 320 is electrically connected to the first node N1 and the eleventh node N11, which are output terminals of the rectification unit 200. The light-emitting unit 320 includes a plurality of light-emitting groups LED5, LED6, LED7 and LED8. Each of the light-emitting groups LED5, LED6, LED7 and LED8 includes at least one light emitting diode or at least one light emitting diode chip. Accordingly, the light-emitting groups LED5, LED6, LED7 and LED8 are realized through series connection, parallel connection or a combination of series/parallel connection between the light emitting diodes. Further, the light emitting diodes constituting each of the light-emitting groups LED5, LED6, LED7 and LED8 may have different features.

In FIG. 4, a fifth light-emitting group LED5 is connected between the first node N1 and a seventh node N7. In addition, a sixth light-emitting group LED6 is connected between the seventh node N7 and an eighth node N8, a seventh light-emitting group LED7 is connected between the eighth node N8 and a ninth node N9, and an eighth light-emitting group LED8 is connected between the ninth node N9 and a tenth node N10. Thus, the light-emitting groups LED5, LED6, LED7 and LED8 are connected to one another in series. In addition, the number of light-emitting groups connected to one another in series may differ according to embodiments.

The constant current unit 420 may be connected to the light-emitting unit 320. The constant current unit 420 includes a current source. The current source may be composed of current diodes CRD5, CRD6, CRD7 and CRD8. The current diodes CRD5, CRD6, CRD7 and CRD8 are electronic elements capable of supplying a predetermined amount of current even in the case of variation in voltage applied thereto. Accordingly, current flowing in the light-emitting diode of the light-emitting unit 320 through the current diodes CRD5, CRD6, CRD7 and CRD8 may be determined. This means that brightness of each of the light-emitting group LED5, LED6, LED7 and LED8 may be controlled by a current set to each of the current diodes CRD5, CRD6, CRD7 and CRD8.

Further, the current source may be realized using two-terminal elements as well as the current diodes. That is, any two-terminal elements capable of generating current may be used as the current source.

The constant current unit 420 includes the current diodes CRD5, CRD6, CRD7 and CRD8 and distribution resistors R5, R6, R7 and R8.

The current diodes CRD5, CRD6, CRD7 and CRD8 are branched from the nodes N7, N8, N9 and N10 between the light-emitting groups LED5, LED6, LED7 and LED8, respectively. For example, a fifth current diode CRD5 is branched from the seventh node N7 and a sixth current diode CRD6 is branched from the eighth node N8. In addition, a seventh current diode CRD7 is branched from the ninth node N9 and an eighth current diode CRD8 is branched from the tenth node N10.

Further, distribution resistors are connected between the current diodes. For example, a fifth distribution resistor R5 is connected between a twelfth node N12 and a thirteenth node N13, and a sixth distribution resistor R6 is connected between the thirteenth node N13 and a fourteenth node N14. Further, a seventh distribution resistor R7 is connected between the fourteenth node N14 and a fifteenth node N15. An eighth distribution resistor R8 is connected between the fifteenth node N15 and the eleventh node N11.

The aforementioned circuit configuration means that the light-emitting groups, the current diodes and the distribution resistors are arranged to constitute a trapezoidal circuit.

In the trapezoidal circuit, a current flowing through each of the distribution resistors is determined by current values set to the current diodes.

FIG. 5 is a directed graph representing a circuit network model of the lighting apparatus shown in FIG. 4.

Referring to FIG. 5, assuming that pull-in current In flows through a branch between the first node N1 and the seventh node N7. In FIG. 4, the current Iin flows through the fifth light-emitting group LED5.

In addition, the fifth current diode CRD5 is provided to a branch between the seventh node N7 and the twelfth node N12. A current flowing through the fifth current diode CRD5 is defined as a fifth current I5. Thus, a current flowing through a branch between the seventh node N7 and the eighth node N8 becomes Iin-I5. That is, the current flowing through the sixth light-emitting group LED6 becomes Iin-I5.

In addition, the sixth current diode CRD6 is provided to a branch between the eighth node N8 and the thirteenth node N13. A current flowing through the sixth current diode CRD6 is defined as a sixth current I6. Thus, a current flowing through a branch between the eighth node N8 and the ninth node N9 becomes Iin-I5-I6. Thus, the current Iin-I5-I6 flows through a seventh light-emitting group LED7.

The current Iin-I5-I6 flowing through the seventh light-emitting group LED7 enters the ninth node N9. The seventh current diode CRD7 is provided to a branch between the ninth node N9 and the fourteenth node N14, and a current flowing therethrough is defined as a seventh current I7. Thus, a current flowing through the eighth light-emitting group LED8 provided to a branch between the ninth node N9 and the tenth node N10 is set to Iin-I5-I6-I7.

A current flowing through the eighth light-emitting group LED8 is the same as an eighth current I8 that flows through the eighth current diode CRD8 disposed between the tenth node N10 and the fifteenth node N15.

This means that the pull-in current Iin flowing from the first node N1 is I5+I6+I7+I8. That is, a current flowing through each of the light-emitting groups LED5, LED6, LED7 and LED8 connected to one another in series does not exhibit characteristics according to a typical voltage-current curve, and depends on a current value set to a current diode branched from a node between the light-emitting groups connected in series.

That is, the current flowing through each of the light-emitting groups is represented by the following equations.

Current $I$in flowing through fifth light-emitting group=$I5+I6+I7+I8$ Equation 7

Current $I$in-$I5$ flowing through sixth light-emitting group=$I6+I7+I8$ Equation 8

Current $I$in-$I5$-$I6$ flowing through seventh light-emitting group=$I7+I8$ Equation 9

Current $I$in-$I5$-$I6$-$I7$ flowing through eighth light-emitting group=$I8$ Equation 10

According to these equations, when the pull-in current Iin enters the seventh node N7, a current of a current diode provided to the farthest node from the seventh node N7 flows through light-emitting groups connected to the farthest node from the seventh node N7. In FIG. 5, the eighth current I8 of the eighth current diode CRD8 commonly flows through all of the light-emitting groups LED5, LED6, LED7 and LED8. This means that a current of each of the current diodes CRD5, CRD6, CRD7 and CRD8 provided to each of the branches between the light-emitting group LED5, LED6, LED7 and LED8 connected to one another in series commonly flows through the branches between previous nodes.

The current values I5, I6, I7 and I8 set to the current diodes to flow in the branches may be selected in various ways.

For example, the current value of the current diode branched from the farthest node from the second node N2 which the pull-in current Iin enters is set to the highest value. Thus, the current values of the current diodes may be set according to the following equation.

$$I8>I7>I6>I5 \quad \text{Equation 11}$$

In this equation, the eighth current I8 set to the eighth current diode CRD8 has the highest current value. In addition, the fifth current I5 set to the fifth current diode CRD5 has the lowest current value.

Further, in this embodiment, magnitude of resistance provided to the directional branches may be changed in various ways.

For example, distribution resistors provided to respective directional branches may have different resistance values. For example, the resistance values of the distribution resistors may be set to increase with decreasing distance to the first node N1. Such a feature may be set after determination of the current values as represented by Equation 11. With such a difference in resistance between the distribution resistors, power consumed by the respective directional branches can be efficiently distributed.

In addition, it is desirable that a fifth distribution resistor R5 connected between the twelfth node N12 and the thirteenth node N13 have a higher resistance than a sixth distribution resistor R6 connected between the thirteenth node N13 and the fourteenth node N14. Further, it is desirable that a seventh distribution resistor R7 have a lower resistance than the sixth distribution resistor R6.

With such a difference in resistance between the distribution resistors, power consumed by the respective current diodes can be efficiently distributed. For example, voltage of the seventh node N7 is kept higher than that of the eighth node N8. In the case where the distribution resistors are not used, the current diodes are directly connected to the eleventh node N11. As a result, voltage between both terminals of each of the current diodes CRD5 and CRD6 is directly affected by the voltage of each of the seventh node N7 and the eighth node N8. Accordingly, the voltage between both terminals of the current diode CRD5 is higher than the voltage between both terminals of the current diode CDR6. This condition is undesirable to drive the current diodes. Accordingly, it is desirable that the distribution resistors be arranged such that the current diodes have the same or similar voltages between both terminals thereof. To this end, the distribution resistor is set to a higher resistance value with decreasing distance to the seventh node N7.

In addition, power generated by the fifth distribution resistor R5 is $R5*I5^2$ and power generated by the seventh distribution resistor R7 is $R7*(I5+I6+I7)^2$. This means that power generated by the resistors can be concentrated on the seventh distribution resistor R7. Accordingly, the seventh distribution resistor R7 may be set to a low resistance value to minimize power loss due to an operation of adding the current values. In addition, the fifth distribution resistor R5 may be set to the highest resistance value to achieve efficient distribution of power generated by each of the resistors. With this structure, power generated between the nodes through each of the distribution resistors can be efficiently distributed. In addition, it is possible to prevent damage to the current diodes due to concentration of power consumption on a certain node caused by concentration of current.

Distribution of the resistance values may be determined according to the following equation.

$$R5>R6>R7 \quad \text{Equation 12}$$

With the aforementioned operation, a current flowing through each of the light-emitting groups may be determined based only on the current values set to the current diodes. In addition, it is possible to prevent concentration of power on a certain node through suitable distribution of resistance.

FIG. 6 is a voltage-current graph representing operation of the lighting apparatuses shown in FIG. 2 and FIG. 4.

Referring to FIG. 6, voltage $V_{N1}$ is applied to the first node N1. Assuming the voltage has a partial sine waveform and is a ripple voltage. In addition, when each of the current diodes is activated, current values set to the current diodes are represented by Equation 11 or 5. Accordingly, FIG. 6 will be described on the assumption of a relationship of I8>I7>I6>I5.

In FIG. 4, as a level of the applied voltage $V_{N1}$ is increased, the fifth light-emitting group LED5 is turned on and the current I5 flows through the fifth current diode CRD5. Further, a terminal voltage of the fifth current diode CRD5 increases with increasing applied voltage $V_{N1}$.

Then, as the applied voltage $V_{N1}$ is further increased, the sixth light-emitting group LED6 is also turned on. In addition, the sixth current diode CRD6 also starts to operate. Accordingly, the pull-in current Iin is the sum of the fifth current I5 and the sixth current I6. Further, a terminal voltage V6 of the sixth current diode CRD6 also gradually increases. At this time, a constant current flows through the fifth current diode CRD5.

Then, as the applied voltage $V_{N1}$ is further increased, the seventh light-emitting group LED7 is also turned on. In addition, the seventh current diode CRD7 also starts to operate. Accordingly, the pull-in current Iin becomes I5+I6+I7, and a terminal voltage V7 of the seventh current diode CRD7 also gradually increases with increasing applied voltage.

When the applied voltage $V_{N1}$ is additionally increased, all of the light-emitting groups are turned on, and the current diode CRD8 also starts to operate, whereby the eighth current I8 flows therethrough. Accordingly, the pull-in current Iin becomes I5+I6+I7+I8.

As the applied voltage $V_{N1}$ drops after reaching a peak value, the lighting apparatus operates in a symmetrical way to the case where the applied voltage $V_{N1}$ is increased. Namely, light emitting operation is sequentially stopped in order of the eighth light-emitting group LED8, the seventh light-emitting group LED7, the sixth light-emitting group LED6 and the fifth light-emitting group LED5. Likewise, the current values are set corresponding thereto.

The aforementioned operation is equally applied to FIG. 4. In this embodiment, I5 corresponds to the first current I1, I6 corresponds to the second current I2, I7 corresponds to the third current I3, and I8 corresponds to the fourth current I4. In addition, CRD5 corresponds to the first current diode CRD1, CRD6 corresponds to the second current diode CRD2, CRD7 corresponds to the third current diode CRD3, and CRD8 corresponds to the fourth current diode CRD4. Likewise, the fifth light-emitting group LED5 corresponds to the first light-emitting group LED1, the sixth light-emitting group LED6 corresponds to the second light-emitting group LED2, the seventh light-emitting group LED7 corresponds to the third light-emitting group LED3, and the eighth light-emitting group LED8 corresponds to the fourth light-emitting group LED4.

Through the aforementioned operation, a maximum current flowing through each of the light-emitting groups may be determined by the current values set to the current diodes. In addition, it is possible to prevent concentration of power on a certain node through suitable distribution of resistance.

Although some embodiments have been described herein, it should be understood by those skilled in the art that these embodiments are given by way of illustration only and do not restrict the scope of the present invention, and that various modifications, variations and alterations can be made without departing from the spirit and scope of the present invention.

The invention claimed is:

1. A light-emitting diode lighting apparatus, comprising:

An alternating current (AC) voltage supply configured to supply AC voltage;

a rectification unit configured to rectify the AC voltage;

a light-emitting unit comprising light-emitting groups, the light-emitting unit configured to receive the rectified AC voltage supplied from the rectification unit and emit light from the light-emitting groups; and a constant current unit comprising current diodes branched from nodes respectively disposed between the light-emitting groups of the light-emitting unit and distribution resistors connected to each of the current diodes, the constant current unit configured to set a current of each of the light-emitting groups, wherein the light-emitting groups of the light-emitting unit are connected to each other in series, and wherein current values of the current diodes are set to decrease with decreasing distance from an $n^{th}$ node, to which an output voltage of the rectification unit is applied, to an $n+m^{th}$ node, from which the corresponding current diode is branched, wherein resistance values of the distribution resistors increase with decreasing distance from an $n^{th}$ node, to which an output voltage of the rectification unit is applied, to an $n+m^{th}$ node from which the corresponding distribution resistor is branched, wherein power consumed by each of the distribution resistors is the same, wherein n and m are positive integers.

2. The light-emitting diode lighting apparatus of claim 1, wherein pull-in current supplied from the constant current unit to the light-emitting unit is the same as the sum of a current values set to the current diodes.

3. A light-emitting diode lighting apparatus, comprising:

an alternating current (AC) voltage supply configured to supply AC voltage;

a rectification unit configured to rectify the AC voltage and to supply rectified voltage to a first node;

a light-emitting unit connected to the first node and configured to emit light; and a constant current unit branched from the first node of the light-emitting unit and configured to set a current flowing through the light-emitting unit, wherein the light-emitting unit comprises:

a first light-emitting group connected between the first node and a second node;

a second light-emitting group connected between the second node and a third node; and a third light-emitting group connected between the third node and a fourth node, and wherein the constant current unit comprises:

a first current diode branched from the second node and configured to generate a first current and a first distribution resistor connected to the first current diode;

a second current diode branched from the third node and configured to generate a second current and a second distribution resistor connected to the second current diode; and a third current diode branched from the fourth node and configured to generate a third current and a third distribution resistor connected to the third current diode, wherein the value of each current diode decreases with decreasing distance from the first node, the third current being larger than the second current, and the second current being larger than the first current, wherein the first distribution resistor has a larger resistance value than the second distribution resistor, and the second distribution resistor has a lamer resistance value than the third distribution resistor, wherein power consumed by each of the distribution resistors is the same.

* * * * *